US008156758B2

(12) United States Patent
Denton et al.

(10) Patent No.: US 8,156,758 B2
(45) Date of Patent: Apr. 17, 2012

(54) METHOD OF EXTRACTING ETHANE FROM LIQUEFIED NATURAL GAS

(75) Inventors: Robert D. Denton, Doha (QA); Russell H. Oelfke, Houston, TX (US); Allen E. Brimm, Houston, TX (US)

(73) Assignee: Exxonmobil Upstream Research Company, Houston, TX (US)

( * ) Notice: Subject to any disclaimer, the term of this patent is extended or adjusted under 35 U.S.C. 154(b) by 1172 days.

(21) Appl. No.: 11/662,027

(22) PCT Filed: Aug. 17, 2005

(86) PCT No.: PCT/US2005/029287

§ 371 (c)(1),
(2), (4) Date: Mar. 6, 2007

(87) PCT Pub. No.: WO2006/031362

PCT Pub. Date: Mar. 23, 2006

(65) Prior Publication Data

US 2008/0087041 A1 Apr. 17, 2008

Related U.S. Application Data

(60) Provisional application No. 60/609,629, filed on Sep. 14, 2004.

(51) Int. Cl.
*F25J 3/00* (2006.01)

(52) U.S. Cl. ..... 62/620

(58) Field of Classification Search ..... 62/50.1, 62/617, 620, 618, 619, 621, 622, 628
See application file for complete search history.

(56) References Cited

U.S. PATENT DOCUMENTS 2,541,569 A 2/1951 Born et al.
2,601,077 A * 6/1952 Wylie ..... 62/620
2,952,984 A 9/1960 Marshall
(Continued)

FOREIGN PATENT DOCUMENTS

EP 0 818 527 A2 1/1998
(Continued)

OTHER PUBLICATIONS

Huang S. et al., "Select the Optimum Extraction Method for LNG Regasification" Hydrocarbon Processing, Jul. 2004, pp. 57-62.
(Continued)

*Primary Examiner* — Frantz Jules
*Assistant Examiner* — Lukas Baldridge
(74) *Attorney, Agent, or Firm* — Exxonmobil Upstream Research Company Law Dept.

(57) ABSTRACT

Methods and systems for recovery of natural gas liquids (NGL) and a pressurized methane-rich sales gas from liquefied natural gas (LNG) are disclosed. In certain embodiments, LNG passes through a heat exchanger, thereby heating and vaporizing at least a portion of the LNG. The partially vaporized LNG passes to a fractionation column where a liquid stream enriched with ethane plus and a methane-rich vapor stream are withdrawn. The withdrawn methane-rich vapor stream passes through the heat exchanger to condense the vapor and produce a two phase stream, which is separated in a separator into at least a methane-rich liquid portion and a methane-rich gas portion. A pump pressurizes the methane-rich liquid portion prior to vaporization and delivery to a pipeline. The methane-rich gas portion may be compressed and combined with the vaporized methane-rich liquid portion or used as plant site fuel.

21 Claims, 1 Drawing Sheet

U.S. PATENT DOCUMENTS

| | | | | |
|---|---|---|---|---|
| 2,975,607 | A | 3/1961 | Bodle | |
| 3,253,418 | A | 5/1966 | Harmens | |
| 3,261,169 | A | 7/1966 | Harmens | |
| 3,282,060 | A | 11/1966 | Hays | |
| 3,331,214 | A | 7/1967 | Proctor et al. | |
| 3,367,122 | A | 2/1968 | Tutton | |
| 3,405,530 | A | 10/1968 | Denahan et al. | |
| 3,407,052 | A | 10/1968 | Huntress et al. | |
| 3,420,068 | A | 1/1969 | Petit | |
| 3,446,029 | A | 5/1969 | Grgurich et al. | |
| 3,452,548 | A | 7/1969 | Pitaro | |
| 3,456,032 | A | 7/1969 | Kniel | |
| 3,524,897 | A | 8/1970 | Kniel | |
| 3,548,024 | A | 12/1970 | Kniel | |
| 3,633,371 | A | 1/1972 | Davison | |
| 3,656,312 | A | 4/1972 | Streich | |
| 3,663,644 | A | 5/1972 | Harvey | |
| 3,721,099 | A | 3/1973 | Forg et al. | |
| 3,724,229 | A | 4/1973 | Seliber | |
| 3,766,583 | A | 10/1973 | Phelps | |
| 3,827,247 | A | 8/1974 | Kojima et al. | |
| 3,837,172 | A | 9/1974 | Markbreiter et al. | |
| 3,837,821 | A | 9/1974 | Buffiere et al. | |
| 3,846,993 | A | 11/1974 | Bates | |
| 3,849,096 | A | 11/1974 | Kniel | |
| 3,950,958 | A | 4/1976 | Loofbourow | |
| 3,990,256 | A | 11/1976 | May et al. | |
| 4,121,917 | A | 10/1978 | Baker et al. | |
| 4,399,659 | A | 8/1983 | Strigl | |
| 4,437,312 | A | 3/1984 | Newton et al. | |
| 4,444,015 | A | 4/1984 | Matsumoto et al. | |
| 4,479,350 | A | 10/1984 | Newton et al. | |
| 4,526,594 | A * | 7/1985 | Mehra | 62/625 |
| 4,675,037 | A | 6/1987 | Newton | |
| 4,690,702 | A | 9/1987 | Paradowski et al. | |
| 4,710,212 | A | 12/1987 | Hanson et al. | |
| 4,732,598 | A * | 3/1988 | Rowles et al. | 62/621 |
| 4,738,699 | A | 4/1988 | Apffel | |
| 4,747,858 | A | 5/1988 | Gottier | |
| 4,753,667 | A | 6/1988 | O'Connell et al. | |
| 4,778,498 | A | 10/1988 | Hanson et al. | |
| 4,995,234 | A | 2/1991 | Kooy et al. | |
| 5,114,451 | A | 5/1992 | Rambo et al. | |
| 5,141,543 | A | 8/1992 | Agrawal et al. | |
| 5,359,856 | A | 11/1994 | Rhoades et al. | |
| 5,390,499 | A | 2/1995 | Rhoades et al. | |
| 5,394,686 | A | 3/1995 | Child et al. | |
| 5,421,165 | A | 6/1995 | Paradowski et al. | |
| 5,505,049 | A | 4/1996 | Coyle et al. | |
| 5,615,561 | A | 4/1997 | Houshmand et al. | |
| 5,881,569 | A | 3/1999 | Campbell et al. | |
| 5,890,378 | A | 4/1999 | Rambo et al. | |
| 5,893,274 | A | 4/1999 | Nagelvoort et al. | |
| 5,983,664 | A | 11/1999 | Campbell et al. | |
| 6,014,869 | A | 1/2000 | Elion et al. | |
| 6,070,429 | A | 6/2000 | Low et al. | |
| 6,089,028 | A | 7/2000 | Bowen et al. | |
| 6,109,061 | A | 8/2000 | Gaskin | |
| 6,116,031 | A | 9/2000 | Minta et al. | |
| 6,237,365 | B1 | 5/2001 | Trebble | |
| 6,298,671 | B1 | 10/2001 | Kennelley et al. | |
| 6,367,258 | B1 | 4/2002 | Wen et al. | |
| 6,374,591 | B1 | 4/2002 | Johnson et al. | |
| 6,401,486 | B1 * | 6/2002 | Lee et al. | 62/630 |
| 6,474,101 | B1 | 11/2002 | Quine et al. | |
| 6,510,706 | B2 | 1/2003 | Stone et al. | |
| 6,517,286 | B1 | 2/2003 | Latchem | |
| 6,564,579 | B1 * | 5/2003 | McCartney | 62/620 |
| 6,564,580 | B2 | 5/2003 | Bowen et al. | |
| 6,578,365 | B2 | 6/2003 | Sicherman | |
| 6,604,380 | B1 * | 8/2003 | Reddick et al. | 62/620 |
| 2001/0042376 | A1 | 11/2001 | Johnson et al. | |
| 2002/0029585 | A1 | 3/2002 | Stone et al. | |
| 2002/0134455 | A1 | 9/2002 | Emblem et al. | |
| 2002/0174662 | A1 | 11/2002 | Frimm et al. | |
| 2003/0005698 | A1 | 1/2003 | Keller | |
| 2003/0014981 | A1 | 1/2003 | Kimble et al. | |
| 2003/0014995 | A1 | 1/2003 | Bowen et al. | |
| 2003/0158458 | A1 * | 8/2003 | Prim | 585/800 |
| 2005/0155381 | A1 | 7/2005 | Yang et al. | |
| 2005/0218041 | A1 | 10/2005 | Yoshida et al. | |

FOREIGN PATENT DOCUMENTS

| | | | |
|---|---|---|---|
| FR | 2 804 751 | A1 | 8/2001 |
| GB | 1008394 | | 10/1965 |
| GB | 1150798 | | 4/1969 |
| JP | 57-43099 | | 3/1982 |
| WO | WO 90/00589 | | 1/1990 |
| WO | WO 99/50536 | | 10/1999 |
| WO | WO 99/50537 | | 10/1999 |
| WO | WO 00/36333 | | 6/2000 |
| WO | WO 03/023304 | A1 | 3/2003 |
| WO | WO 2006/026525 | A2 | 3/2006 |

OTHER PUBLICATIONS

McCartney, Dan, "Gas Conditioning for Imported LNG", 82nd Annual Convention Gas Processors Association, Mar. 11, 2002, San Antonio, Texas, 11 pages.

Yang, C. C. et al., "Cost-Effective Design Reduces $C_2$ and $C_3$ at LNG Receiving Terminals," Oil and Gas Journal, May 26, 2003, pp. 50-53.

European Search Report No. 112038, dated Mar. 16, 2005, for U.S. Appl. No. 60/609,629, 4 pages.

PCT International Search Report and Written Opinion, mailed Feb. 8, 2006 for PCT/US05/29287, 8 pages.

PCT International Preliminary Report on Patentability, mailed Dec. 12, 2006, for PCT/US05/29287, 11 pages.

* cited by examiner

METHOD OF EXTRACTING ETHANE FROM LIQUEFIED NATURAL GAS

CROSS REFERENCE TO RELATED APPLICATIONS

This application is the National Stage of International Application PCT/US05/29287 filed Aug. 17, 2005 which claims the benefit of U.S. Provisional Application 60/609,629, filed 14 Sep., 2004.

BACKGROUND

1. Field of Invention

Embodiments of the invention generally relate to systems and methods of processing hydrocarbons. More specifically, embodiments of the invention relate to recovery of natural gas liquids and a pressurized methane-rich sales gas from liquefied natural gas.

2. Description of Related Art

Natural gas is commonly recovered in remote areas where natural gas production exceeds demand within a range where pipeline transportation of the natural gas is feasible. Thus, converting the vapor natural gas stream into a liquefied natural gas (LNG) stream makes it economical to transport the natural gas in special LNG tankers to appropriate LNG handling and storage terminals where there is increased market demand. The LNG can then be revaporized and used as a gaseous fuel for transmission through natural gas pipelines to consumers.

The LNG consists primarily of saturated hydrocarbon components such as methane, ethane, propane, butane, etc. Additionally, the LNG may contain trace quantities of nitrogen, carbon dioxide, and hydrogen sulfide. Separation of the LNG provides a pipeline quality gaseous fraction of primarily methane that conforms to pipeline specifications and a less volatile liquid hydrocarbon fraction known as natural gas liquids (NGL). The NGL include ethane, propane, butane, and minor amounts of other heavy hydrocarbons. Depending on market conditions it may be desirable to recover the NGL because its components may have a higher value as liquid products, where they are used as petrochemical feedstocks, compared to their value as fuel gas.

Various techniques currently exist for separating the methane from the NGL during processing of the LNG. Information relating to the recovery of natural gas liquids and/or LNG revaporization can be found in: Yang, C. C. et al., "Cost effective design reduces C2 and C3 at LNG receiving terminals," Oil and Gas Journal, May 26, 2003, pp. 50-53; US 2005/0155381 A1; US 2003/158458 A1; GB 1 150 798; FR 2 804 751 A; US 2002/029585; GB 1 008 394 A; U.S. Pat. No. 3,446,029; and S. Huang, et al., "Select the Optimum Extraction Method for LNG Regasification," Hydrocarbon Processing, vol. 83, July 2004, pp. 57-62.

There exists, however, a need for systems and methods of processing LNG that increase efficiency when separating NGL from a methane-rich gas stream. There exists a further need for systems and methods of processing LNG that enable selective diverting of the LNG to a flow path that vaporizes both methane and ethane plus within the LNG.

SUMMARY

Embodiments of the invention generally relate to methods and systems for recovery of natural gas liquids (NGL) and a pressurized methane-rich sales gas from liquefied natural gas (LNG). In certain embodiments, LNG passes through a heat exchanger, thereby heating and vaporizing at least a portion of the LNG. The partially vaporized LNG passes to a fractionation column where a liquid stream enriched with ethane plus and a methane-rich vapor stream are withdrawn. The withdrawn methane-rich vapor stream passes through the heat exchanger to condense the vapor and produce a two phase stream, which is separated in a separator into at least a methane-rich liquid portion and a methane-rich gas portion. A pump pressurizes the methane-rich liquid portion prior to vaporization and delivery to a pipeline. The methane-rich gas portion may be compressed and combined with the vaporized methane-rich liquid portion or used as plant site fuel.

BRIEF DESCRIPTION OF THE DRAWINGS

Aspects of specific embodiments of the inventions are shown in the following drawing.

DETAILED DESCRIPTION

Introduction and Definitions

Figure 1:
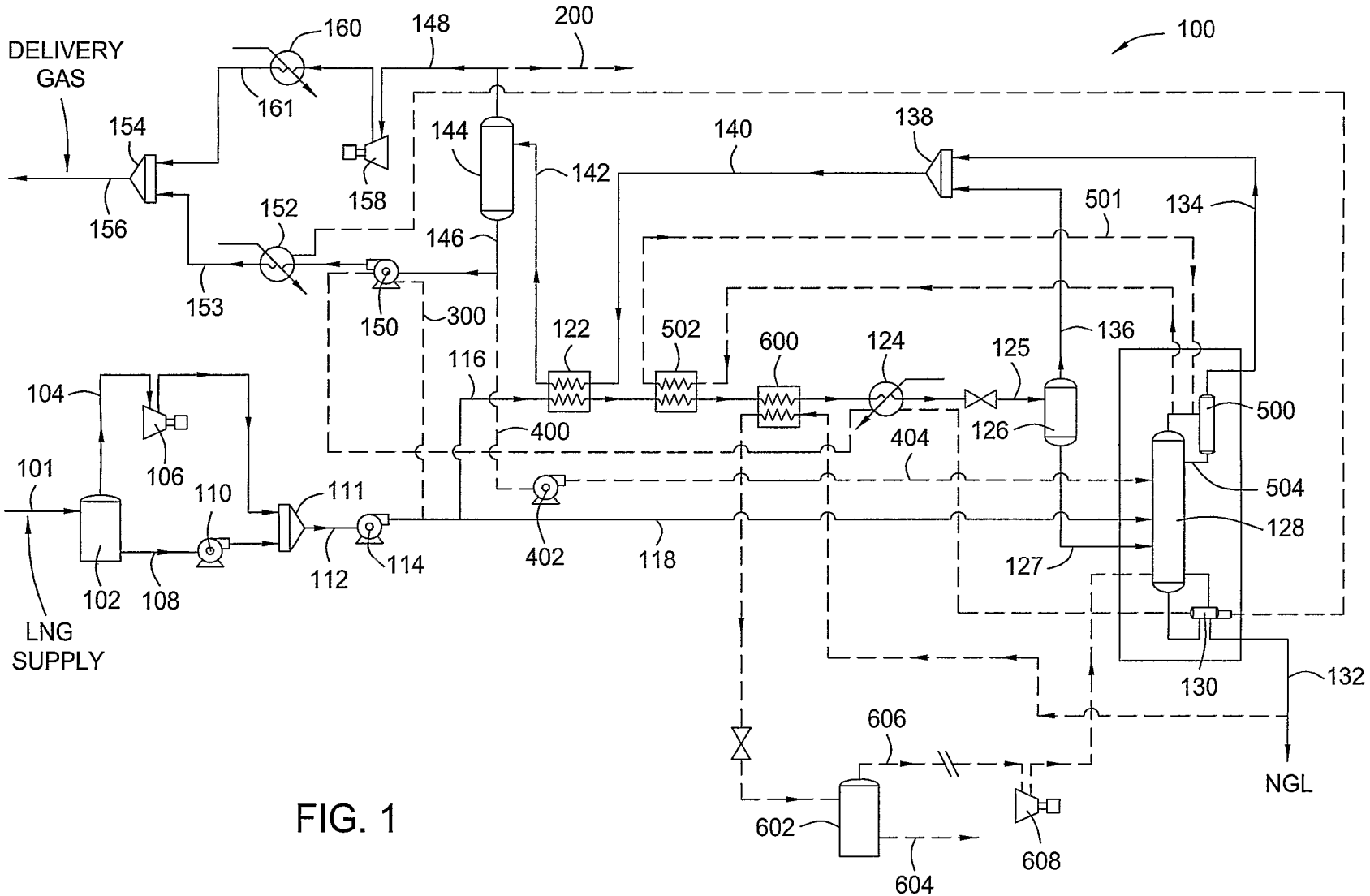
FIG. 1 is a flow diagram of a processing system for liquefied natural gas.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology. Various terms as used herein are defined below. To the extent a term used in a claim is not defined below, it should be given the broadest definition persons in the pertinent art have given that term as reflected in one or more printed publications or issued patents.

The term "heat exchanger" broadly means any device capable of transferring heat from one media to another media, including particularly any structure, e.g., device commonly referred to as a heat exchanger. Thus, the heat exchanger may be a plate-and-frame, shell-and-tube, spiral, hairpin, core, core-and-kettle, double-pipe or any other type on known heat exchanger. Preferably, the heat exchanger is a brazed aluminum plate fin type.

The term "fractionation system" means any structure that has one or more distillation columns, e.g., a heated column containing trays and/or random or structured packing to provide contact between liquids falling downward and vapors rising upward. The fractionation system may include one or more columns for recovering NGL, which may be processed in one or more additional fractionation columns to separate the NGL into separate products including ethane, propane and butane plus fractions.

The term "liquefied natural gas" (LNG) means natural gas from a crude oil well (associated gas) or from a gas well (non-associated gas) that is in liquid form, e.g., has undergone some form of liquefaction. In general, the LNG contains methane ($C_1$) as a major component along with minor components such as ethane ($C_2$) and higher hydrocarbons and contaminants such as carbon dioxide, hydrogen sulfide, and nitrogen. For example, typical $C_1$ concentration in LNG (prior to removal of ethane) is between about 87% and 92%, and typical $C_2$ concentration in LNG is between about 4% and 12%.

The term "methane-rich" refers broadly to any vapor or liquid stream, e.g., after fractionation from which ethane plus amounts have been recovered. Thus, a methane-rich stream has a higher concentration of $C_1$ than the concentration of $C_1$ in LNG. Preferably, the concentration increase of $C_1$ is from removal of at least 95% of the ethane in the LNG and removal of substantially all of the propane plus.

The terms "natural gas liquids" (NGL) and "ethane plus" ($C_{2+}$) refer broadly to hydrocarbons having two or more carbons such as ethane, propane, butane and possibly small quantities of pentanes or higher hydrocarbons. Preferably, NGL have a methane concentration of 0.5 mol percent or less.

The term "plant site fuel" refers to fuel required to run and operate a plant that may include a system for processing LNG such as described herein. For example, the amount of plant site fuel may amount to approximately 1% of a delivery gas produced by the system.

DESCRIPTION OF SPECIFIC EMBODIMENTS

In certain embodiments, a method of processing liquefied natural gas (LNG) includes passing LNG through a heat exchanger to provide heated LNG, fractionating the heated LNG into a methane-rich vapor stream and a natural gas liquids (NGL) stream, passing the methane-rich vapor stream through the heat exchanger to transfer heat from the methane-rich vapor stream to the LNG passing through the heat exchanger and to provide a two-phase stream that includes a methane-rich liquid phase and a methane-rich vapor phase, separating the two-phase stream into at least a methane-rich liquid portion and a methane-rich gas portion, increasing the pressure of the methane-rich liquid portion to provide a send-out liquid stream and recovering the sendout liquid stream to provide a sales gas for delivery to a pipeline.

In other embodiments, a system for processing liquefied natural gas (LNG) includes a heat exchanger, an LNG inlet line in fluid communication with an LNG source and the heat exchanger, configured such that LNG is capable of passing through the LNG inlet line and the heat exchanger, a fractionation system in fluid communication with the heat exchanger, the fractionation system having a first outlet for a methane-rich vapor stream and a second outlet for a natural gas liquids (NGL) stream, a vapor-liquid separator, a condensation line fluidly connecting the first outlet of the fractionation system to the vapor-liquid separator, the condensation line passing though the heat exchanger, configured such that heat from the methane-rich vapor stream is transferred to any LNG passing through the heat exchanger, a pump having an inlet in fluid communication with a liquid recovered in the vapor-liquid separator, and a vaporizer in fluid communication with an outlet of the pump and a pipeline for delivery of sales gas.

In other embodiments, a method of processing liquefied natural gas (LNG) includes (a) providing LNG containing natural gas liquids (NGL), (b) increasing the pressure of the LNG to a first pressure to provide pressurized LNG, (c) passing the pressurized LNG through a heat exchanger to heat the LNG and provide heated LNG, (d) passing the heated LNG to a separation system that produces a methane-rich vapor stream and an NGL stream, (e) passing the methane-rich vapor stream produced by the separation system through the heat exchanger, to provide a two-phase stream that includes a liquid phase and a vapor phase, (f) separating the two-phase stream into at least a liquid portion and a gas portion, (g) increasing the pressure of the liquid portion produced by the methane-rich vapor stream passing through the heat exchanger to a second pressure which is higher than the first pressure to provide a pressurized liquid portion and (h) vaporizing at least a portion of the pressurized liquid portion without further removal of an ethane plus component to produce a high-pressure, methane-rich gas.

DESCRIPTION OF EMBODIMENTS SHOWN IN THE DRAWING

FIG. 1 illustrates an example of one or more methods and systems for processing LNG. The solid lines in FIG. 1 connecting the various components denote hydrocarbon streams, e.g., flowing LNG or NGL compositions contained within a conduit, e.g., a pipe. Structures such as flanges and valves are not shown, but are nonetheless considered to be part of the system. Each stream may be a liquid, or gas, or a two-phase composition as the case may be. Arrows denote direction of flow of the respective stream. Broken lines denote alternative or additional streams.

An LNG processing system 100 includes an LNG supply 101, a primary heat exchanger 122, a fractionation column 128, and an output separator 144. The LNG supply 101 feeds into an LNG tank 102 where a boil-off vapor stream 104 from the LNG tank 102 is compressed by a feed compressor 106 and an LNG liquid stream 108 from the LNG tank 102 is increased in pressure by a preliminary feed pump 110 prior to mixing in a feed mixer 111 where the compressed boiloff vapor is condensed in order to provide a single phase LNG liquid feed stream 112. The LNG liquid feed stream 112 passes to a main feed pump 114 to increase the pressure of the LNG liquid feed stream 112 to a desired operating pressure that depends on a variety of factors, e.g., the operating parameters of the fractionation column 128 and the desired composition of the NGL to be recovered. Output from the pump 114 creates a pressurized feed stream 116. Preferably, the operating pressure of the pressurized feed stream 116 is between approximately 500 and 600 psia. Alternatively, the operating pressure may range from as low as 200, or 300, or 400 psia to as high as 700, or 800, or 900 psia. In some applications, the LNG supply 101 is at a sufficient operating pressure such that the LNG supply 101 feeds into the heat exchanger 122 without requiring increase in pressure. A portion of the pressurized feed stream 116 may be separated to provide a reflux stream 118 that provides an external reflux for the fractionation column 128.

The pressurized feed stream 116 feeds the primary heat exchanger 122 where the pressurized feed stream 116 is heated and partially or wholly vaporized. The pressurized feed stream 116 is preferably at a temperature of about −250° F. before it enters the primary heat exchanger 122. Feed stream 116 passes through the primary heat exchanger 122, then it may also pass through an external heat supply 124, e.g., an optional feed vaporizer, which provides further heating. In a particular advantageous feature, the external heat supply 124 can provide temperature modulation prior to feeding of the LNG stream to a demethanizer separator 126 as a heated feed stream 125 at a temperature that is preferably approximately −120° F., but alternatively can range from a low of −160° F., or −150° F., or −140° F., to a high of −110° F., or −100° F., or −90° F. The demethanizer separator 126 is preferably a fractionation column, and may be omitted, combined with or an integral part of the fractionation column 128 in some embodiments, e.g., to form a fractionation system. The demethanizer separator 126 provides separation of the heated feed stream 125 into a gas phase that forms a methane-rich vapor stream 136 and a liquid phase that forms a fractionation column feed stream 127. The fractionation column feed stream 127 enters the fractionation column 128 and fractionates into a methane-rich overhead stream 134 and an NGL stream 132. A reboiler 130 for the fractionation column 128 adds heat to facilitate distillation operations and increase removal of methane from the NGL. The reboiler 130 may add heat by one or more submerged combustion vaporizers or a stand alone heating system.

The methane-rich overhead stream 134 from the fractionation column 128 mixes with the methane-rich vapor stream 136 in vapor mixer 138 to provide a combined methane-rich vapor stream 140. The vapor stream 140 passes through the primary heat exchanger 122 where the vapor stream 140 exchanges heat with the feed stream 116, thereby effectively utilizing the refrigeration potential of the LNG supply 101 which is preferably at a temperature of approximately −250° F. before it enters the heat exchanger, but may also be any desirable temperature, e.g., ranging from a high of −225° F., or −200° F. to a low of −275° F. In at least one advantageous feature, the vapor stream 140 is not compressed prior to being passed through the primary heat exchanger 122 in order to increase efficiency in the system 100, based on the premise that gas compression requires more energy than pumping liquid. Thus, compressing the vapor stream 140 prior to condensing the vapor stream 140 in the primary heat exchanger 122 requires more energy than the energy consumed by the system 100 shown in FIG. 1. The vapor stream 140 partially condenses in the heat exchanger 122 and exits the heat exchanger 122 as a two-phase stream 142. Preferably, at least 85% of the vapor stream 140 condenses into a liquid in the heat exchanger 122; more preferably at least 90% of the vapor stream 140 condenses into a liquid in the heat exchanger 122; and most preferably at least 95% of the vapor stream 140 condenses into a liquid in the heat exchanger 122. Even if the conditions of service appear to allow most of the vapor to be condensed, it will normally be desirable to leave some residual vapor. The compressor, e.g., the compressor 158 discussed below, should be sized to handle the transients, which may generate vapor during non-steady state operation. The two-phase stream 142 is separated into a methane-rich liquid stream 146 and a methane-rich output gas stream 148 in an output separator 144, e.g., a two phase flash drum. Thus, the majority of the vapor stream 140 forms the methane-rich liquid stream 146 which can easily be pumped to sendout pressure by a sendout pump 150 without requiring costly and inefficient compressing. Likewise, only a minor portion of the vapor stream 140 forms the output gas stream 148 that requires boosting to sendout pressure by a sendout compressor 158. After pumping the liquid stream 146 to sendout pressure and boosting the output gas stream 148 to sendout pressure, sendout vaporizer 152 and heater 160, which may both be open rack water vaporizers or submerged combustion vaporizers, provide a heated output gas stream 161 and a vaporized and heated output gas stream 153, respectively. Therefore, the heated output gas stream 161 and the vaporized and heated output gas stream 153 may combine in an output mixer 154 for delivery of a methane-rich delivery gas stream 156 to market (e.g., a gas pipeline that transports gas at high pressure such as above 800 psia).

In a particularly advantageous aspect, the system 100 further enables switching between an "NGL recovery mode" and an "NGL rejection mode." In the NGL recovery mode, most if not all of the NGL is extracted from the LNG supply 101 prior to vaporization of the LNG supply 101, such as described above. However, in the NGL rejection mode, all of the LNG supply 101 (including ethane plus fractions) is vaporized for delivery to market by a diverted path 300 (see broken lines). The pumps 110, 114, 150 can be used to provide the necessary increase in pressure to the LNG supply 101 in order to reach sendout pressure. Further, heat sources such as reboiler 130, vaporizers 124, 152 and heater 160 provide sufficient energy to heat and vaporize the LNG supply 101 to sendout temperature after being pressurized by the pumps 110, 114, 150. Valves and additional conduits may be utilized to bypass components (e.g., the demethanizer separator 126 and the fractionation column 128) not used during the NGL rejection mode and to arrange the pumps ahead of the heat sources during the NGL rejection mode.

FIG. 1 further illustrates numerous options, as indicated by dashed lines and combinations thereof. For example, external reflux for the fractionation column 128 may be provided from various sources other than the reflux stream 118, and the pressurized feed stream 116 may provide refrigeration potential from the LNG supply 101 to additional heat exchangers that may be used in the system 100 after the primary heat exchanger 122. In one or more alternatives, at least a portion of the methane-rich output gas stream 148 can be diverted to a plant site fuel stream 200 that may be heated and used to run and operate the system 100 and accompanying plant.

In an additional aspect or alternative, the methane-rich liquid stream 146 may be separated to provide a lean reflux stream 400 that may be increased in pressure by a pump 402 prior to entering the fractionation column 128 as a lean external reflux stream 404. In order to further improve the effectiveness of the lean external reflux stream 404 in removing heavier hydrocarbons from the overhead of the fractionation column 128, the lean external reflux stream 404 may be chilled by a reflux heat exchanger (not shown) that acts to cool the lean external reflux stream 404 against the pressurized feed stream 116. In a further aspect, the system 100 may include a condenser 500 in fluid communication (e.g., flow path 501) with a condenser heat exchanger 502. The condenser 500 may be a separate or integral part of a rectification section of the fractionation column 128. Fractionation tower overhead heat exchanges directly or indirectly with the pressurized feed stream 116 via the condenser heat exchanger 502 in order to provide a condenser reflux stream 504 for the fractionation column 128. The external refluxes provide particular utility for removing higher hydrocarbons than ethane from the LNG supply 101 and increasing the percentage of NGL removed from the methane-rich overhead stream 134.

In another embodiment where at least a portion of the NGL stream 132 is not delivered directly to market at high pressure, the system 100 may include an NGL heat exchanger 600 to chill the NGL stream 132 against the pressurized feed stream 116 so that there is minimal flash once the NGL stream 132 reduces to atmospheric pressure for storage in an ethane tank 602 or delivery in an output NGL stream 604 at atmospheric pressure. A flash gas stream 606 from the ethane tank 602 may be compressed by an ethane compressor 608 and fed to the bottom of the fractionation column 128 in order to increase NGL recovery via NGL stream 132, avoid flaring of the flash gas stream 606, and reduce the duty of the reboiler 130.

Described below are examples of aspects of the processes described herein, using (but not limited to) the reference characters in FIG. 1 when possible for clarity. A method of processing LNG includes passing pressurized LNG 116 through a heat exchanger 122 to provide heated LNG 125, fractionating the heated LNG 125 into a methane-rich vapor stream 134 and an NGL stream 132, passing the vapor stream 134 through the heat exchanger 122 to provide a two-phase stream 142 that includes a liquid phase and a vapor phase, separating the two-phase stream 142 into at least a liquid portion 146 and a gas portion 148, increasing the pressure of the liquid portion 146 to provide a sendout liquid stream, and recovering the sendout liquid stream for vaporization and delivery to market 153. Another method of vaporizing LNG includes providing a vaporization system 100 having an NGL recovery mode for substantially separating methane from NGL and an NGL rejection mode and switching the vaporization system 100 between the recovery and rejection modes, wherein the modes utilize common pumps 110, 114, 150 and heat sources 124, 130, 152, 160.

EXAMPLES

Example 1

A hypothetical mass and energy balance is carried out in connection with the process shown in solid line in FIG. 1. The data were generated using a commercially available process simulation program called HYSYS™ (available from Hyprotech Ltd. of Calgary, Canada). However, it is contemplated that other commercially available process simulation programs can be used to develop the data, including HYSIM™, PROII™, and ASPEN PLUS™. The data assumed the pressurized feed stream 116 had a typical LNG composition as shown in Table 1. The data presented in Table 1 can be varied in numerous ways in view of the teachings herein, and is included to provide a better understanding of the system shown in solid line in FIG. 1. That system results in recovery of 95.7% (41290 BPD) of ethane from LNG while delivering 1027 MMSCFD of methane-rich gas for delivery at 35° F. and 1215 psia.

TABLE 1

| | LNG Feed Stream 112 | Reflux Stream 118 | Heated Feed Stream 125 | Fractionation Column Feed Stream 127 | Methane-Rich Vapor Stream 136 | NGL Stream 132 |
|---|---|---|---|---|---|---|
| % Vapor | 0.00 | 0.00 | 6.48 | 0.00 | 100.00 | 0.00 |
| Temperature (° F.) | −255.00 | −252.70 | −135.90 | −135.90 | −135.90 | 46.94 |
| Pressure (psia) | 140 | 500 | 430 | 430 | 430 | 430 |
| Molar Flow (lbmole/hr) | 1200.00 | 7522 | 112400 | 105200 | 7284 | 6767 |
| Gas Flow (MMSCFD) | 1093.00 | 68.50 | 1024.00 | 957.70 | 66.34 | 61.63 |
| Mass Flow (lb/hr) | 2031000 | 112700 | 1904000 | 1786000 | 118100 | 203300 |
| Mole % $C_1$ | 93.66 | 93.66 | 93.66 | 93.31 | 98.76 | 0.50 |
| Mole % $C_2$ | 6.21 | 6.21 | 6.21 | 6.58 | 0.93 | 99.20 |
| Mole % $C_{3+}$ | 0.01 | 0.01 | 0.01 | 0.01 | 0.00 | 0.23 |
| Mole % $CO_2$ | 0.01 | 0.01 | 0.01 | 0.01 | 0.00 | 0.07 |
| Mole % $N_2$ | 0.11 | 0.11 | 0.11 | 0.09 | 0.31 | 0.00 |

| | Methane-Rich Overhead Stream 134 | Two-Phase Stream 142 | Methane-Rich Liquid Stream 146 | Methane-Rich Output Gas Stream 148 | Methane-Rich Delivery Gas Stream 156 |
|---|---|---|---|---|---|
| % Vapor | 100.00 | 15.58 | 0.00 | 100.00 | 100.00 |
| Temperature (° F.) | −138.20 | −142.80 | −142.80 | −142.80 | 35.00 |
| Pressure (psia) | 425 | 415 | 415 | 415 | 1215 |
| Molar Flow (lbmole/hr) | 105900 | 113200 | 95560 | 17630 | 113200 |
| Gas Flow (MMSCFD) | 964.60 | 1031.00 | 870.30 | 160.60 | 1031.00 |
| Mass Flow (lb/hr) | 1710000 | 1828000 | 1544000 | 283700 | 1828000 |
| Mole % $C_1$ | 99.26 | 99.23 | 99.15 | 99.63 | 99.23 |
| Mole % $C_2$ | 0.64 | 0.66 | 0.76 | 0.11 | 0.66 |
| Mole % $C_{3+}$ | 0.00 | 0.00 | 0.00 | 0.00 | 0.00 |
| Mole % $CO_2$ | 0.00 | 0.00 | 0.00 | 0.00 | 0.00 |
| Mole % $N_2$ | 0.10 | 0.11 | 0.09 | 0.26 | 0.11 |

Example 2

Table 2 shows a part of another simulation, which provides a comparison of the NGL recovery mode (using the embodiment shown in solid line in FIG. 1) with an NGL rejection mode, wherein the system 100 is switched to vaporize all of the LNG supply 101. As seen, the NGL recovery mode requires an additional power requirement of approximately 5320 HP compared to the NGL rejection mode. Further, the water vaporization load for the NGL recovery mode decreases by approximately 9% compared to the NGL rejection mode. Thus, the utilities required to provide either cooling water or seawater for vaporization is sufficient to handle the NGL recovery mode.

TABLE 2

| | NGL Recovery Mode | NGL Rejection Mode |
|---|---|---|
| | Horsepower (HP) | |
| Main Feed Pump 114 | 3320 | 7290 |
| Sendout Pump 150 | 6510 | |
| Sendout Compressor 158 | 2780 | 0 |
| Total Power | 12610 | 7290 |
| | MBTU/Hr | |
| Reboiler 130 | 236 | 618 |
| Heater 160 | 17 | |
| Vaporizer 152 | 340 | |
| Total MBTU/Hr | 593 | 618 |

Example 3

Table 3 illustrates examples of different alternative concentration ranges of $C_1$ and $C_{2+}$ in various streams shown in FIG. 1.

TABLE 3

| Stream | $C_{1\,min}$ (mole %) | $C_{1\,max}$ (mole %) | $C_{2+\,min}$ (mole %) | $C_{2+\,max}$ (mole %) |
|---|---|---|---|---|
| 112 | 80 | 85 | 2 | 5 |
| | 85 | 90 | 6 | 10 |
| | 90 | 95 | 10 | 15 |
| 134 | 97 | 98 | 0 | 0.5 |
| | 98 | 99 | 0.5 | 1 |
| | 99 | 100 | 1 | 1.5 |
| 140 | 97 | 98 | 0 | 0.5 |
| | 98 | 99 | 0.5 | 1 |
| | 99 | 100 | 1 | 1.5 |
| 146 | 97 | 98 | 0 | 0.5 |
| | 98 | 99 | 0.5 | 1 |
| | 99 | 100 | 1 | 1.5 |
| 153 | 97 | 98 | 0 | 0.5 |
| | 98 | 99 | 0.5 | 1 |
| | 99 | 100 | 1 | 1.5 |

What is claimed is:

1. A method of processing liquefied natural gas (LNG), comprising two alternative modes of operation:

(a) operating in a first mode for recovering a portion of natural gas liquids (NGL) by:

passing LNG through a heat exchanger to provide heated LNG;

fractionating the heated LNG into a methane-rich vapor stream and a natural gas liquids (NGL) stream;

passing the methane-rich vapor stream through the heat exchanger, without increasing the pressure of the methane-rich vapor stream, to transfer heat from the methane-rich vapor stream to the LNG passing through the heat exchanger and to provide a two-phase stream that includes a methane-rich liquid phase and a methane-rich vapor phase;

separating the two-phase stream in a vapor liquid separator into at least a methane-rich liquid portion and a methane-rich gas portion;

increasing the pressure of the methane-rich liquid portion to provide a sendout liquid stream;

recovering the sendout liquid stream to provide a sales gas for delivery to a pipeline; and (b) operating in a second mode for rejecting a portion of NGL by diverting the LNG to a diverted flow path that bypasses the fractionating to provide sales gas that includes methane and ethane plus for delivery to the pipeline;

wherein in mode (a), mode (b), or both mode (a) and (b) the following steps are performed:

providing at least part of a refrigeration duty for the fractionation system by withdrawing a fraction of the LNG before being heated and passing the withdrawn fraction to the fractionation system and passing at least a portion of the methane-rich vapor stream produced by the fractionation system in heat exchange with the LNG to effect cooling of the methane-rich vapor stream and passing at least a portion of the cooled stream to the fractionation system, and heat exchanging the NGL stream with the heated LNG to provide a chilled NGL stream; and flashing the chilled NGL stream to substantially atmospheric pressure to provide a flashed NGL stream, wherein the fractionation system comprises a reflux input in fluid communication with a portion of the liquid recovered in the vapor-liquid separator.

2. The method of claim 1, wherein the methane concentration of the sales gas is substantially the same as the methane concentration of the methane-rich liquid portion.

3. The method of claim 1, wherein fractionating the heated LNG occurs in a fractionating tower, which produces the methane-rich vapor stream at a tower output pressure, and wherein the pressure of the methane-rich vapor stream entering the heat exchanger is substantially the same pressure as the tower output pressure.

4. The method of claim 1, further comprising increasing the pressure of the LNG before passing the LNG through the heat exchanger.

5. The method of claim 1, further comprising:

mixing a compressed boil-off vapor stream from an LNG tank with an LNG liquid stream from the LNG tank increased to a first pressure, wherein the mixing provides an LNG feed stream; and increasing the pressure of the LNG feed stream to a second pressure to provide the LNG for passing through the heat exchanger.

6. The process of claim 5, wherein the first pressure ranges from 400 psia to 600 psia.

7. The process of claim 5, wherein the second pressure ranges from 1000 psia to 1300 psia.

8. The method of claim 1, wherein the methane-rich liquid phase constitutes at least 85 weight percent of the two-phase stream.

9. The method of claim 1, wherein the methane-rich liquid phase constitutes at least 95 weight percent of the two-phase stream.

10. The method of claim 1, wherein passing the methane-rich vapor stream through the heat exchanger occurs without increasing the pressure of the methane-rich vapor stream, and wherein the methane-rich liquid phase occupies at least 85 weight percent of the two-phase stream.

11. The method of claim 1, wherein the sendout liquid stream is at a pressure of at least 1000 psia.

12. The method of claim 1, wherein delivery of sales gas to a pipeline includes transporting methane-rich gas at a pressure of at least 800 psia via the pipeline.

13. The method of claim 1, wherein the methane-rich vapor stream and the sendout liquid stream each has a methane concentration of at least 98 mole percent.

14. The method of claim 1, wherein the NGL stream has an ethane plus concentration of at least 98 mole percent.

15. The method of claim 1, further comprising utilizing at least part of the methane-rich gas portion as a plant site fuel.

16. The method of claim 1, further comprising boosting the pressure of at least part of the methane-rich gas portion for delivery to the pipeline.

17. The method of claim 1, further comprising heat exchanging the NGL stream with the heated LNG to chill the NGL stream.

18. The method of claim 1, further comprising passing the flashed NGL stream to storage.

19. The method of claim 1, further comprising:

splitting a part of the methane-rich liquid portion into a reflux stream; and chilling the reflux stream against the heated LNG to provide a reflux for fractionating the heated LNG.

20. The process of claim 1, wherein the NGL stream has ethane as a predominant component.

21. The process of claim 1, wherein the pressure of LNG of step (a) is at or near atmospheric pressure.

* * * * *